United States Patent [19]

Yamada et al.

[11] Patent Number: 4,768,467

[45] Date of Patent: Sep. 6, 1988

[54] VALVE OPERATING SYSTEM FOR AN AUTOMOTIVE ENGINE

[75] Inventors: Takemasa Yamada, Niiza; Hajime Kashiwase, Tokyo; Satoshi Maeda, Mitaka, all of Japan

[73] Assignee: Fuji Jukogyo Kabushiki Kaisha, Tokyo, Japan

[21] Appl. No.: 4,118

[22] Filed: Jan. 16, 1987

[30] Foreign Application Priority Data

Jan. 23, 1986 [JP] Japan ..... 61-13149
Jan. 23, 1986 [JP] Japan ..... 61-13148

[51] Int. Cl.[4] ..... F07L 1/34

[52] U.S. Cl. ..... 123/90.16; 123/90.49; 123/90.17

[58] Field of Search ..... 123/90.44, 90.16, 198 F, 123/90.17

[56] References Cited

U.S. PATENT DOCUMENTS 4,151,817 5/1979 Mueller ..... 123/90.16
4,203,397 5/1980 Soeters, Jr. ..... 123/90.16
4,607,600 8/1986 Yoshizaki ..... 123/90.44
4,611,558 9/1986 Yoshizaki et al. ..... 123/90.44
4,612,884 9/1986 Ajiki et al. ..... 123/90.44
4,612,887 9/1986 Yoshizaki ..... 123/90.44
4,617,880 10/1986 Yoshizaki ..... 123/90.44

FOREIGN PATENT DOCUMENTS 0001312 1/1985 Japan .
0090906 5/1985 Japan .

*Primary Examiner*—Willis R. Wolfe
*Assistant Examiner*—M. Macy
*Attorney, Agent, or Firm*—Martin A. Farber

[57] ABSTRACT

A valve mechanism for an intake valve has a cam block including a first cam comprising a base circle and a second cam having a lobe and a base circle the diameter of which is equal to that of the base circle of the first cam. A first rocker arm engaging with the first cam and a second rocker arm engaging with the second cam are provided. The first and second rocker arms are rotatably engaged with each other so as to be independently rocked by corresponding cams, and have holes in which a lock pin engages to connect the first and second rocker arms with each other so as to be rocked together by the second cam. The system is arranged to engage and disengage the pin with and from both the holes of the first and second rocker arms at a time when both the rocker arms engage with the base circles at the same time.

11 Claims, 10 Drawing Sheets

VALVE OPERATING SYSTEM FOR AN AUTOMOTIVE ENGINE

BACKGROUND OF THE INVENTION

The present invention relates to a valve operating system for an automotive engine.

A two-intake-valve type engine, each cylinder of which has two intake valves and two exhaust valves, is disclosed in Japanese Patent Application Laid Open No. 60-1312. In the prior art, each intake (exhaust) valve is provided with a rocker arm. An actuator is provided to operatively connect both rocker arms with each other in a high engine speed range to operate both intake valves. In a low engine speed range, both the intake valves are disconnected and one of the valves is operated while the other is closed.

Such a system has advantages that an EGR ratio is reduced and the intake air speed of the engine is increased to improve combustion during a slow rotation or efficiency at low engine speed and light load on the engine.

More particularly, one of the rocker arms is removably engaged with the other by an engaging means operated by the actuator to synchronize the one rocker arm with the other. The engaging means has an engaging pin removably engaged with engaging portions of rocker arms and hydraulic control means for operating the pin.

However, the hydraulic control means is operated by a command when the engine is in predetermined operating conditions of engine speed and engine load, regardless of synchronization with the engaging timing of the pin. Thus, the pin strikes a portion other than the engaging portion of the rocker arm, which causes noises or breakdown of the pin. Further, the pin is subjected to the shearing force when the pin is engaged.

SUMMARY OF THE INVENTION

An object of the present invention is to provide a valve operating system for an automotive engine which can engage a pin with rocker arms at a proper timing, thereby eliminating the above described disadvantages.

According to the present invention, a valve mechanism comprises a cam block including a first cam and a second cam which are different in shape of contour, the first cam having a base circle, the diameter of which is equal to that of a base circle of the second cam, a first rocker arm engaging with the first cam and a second rocker arm engaging with the second cam, the first and second rocker arms being rotatably engaged with each other so as to be independently rocked by corresponding cams, and first means for engaging the first and second rocker arms with each other so as to be rocked together by the second cams.

The system of the present invention has second means for operating the engaging means so as to engage and disengage both the first and second rocker arms at a time when both the rocker arms engage with the base circles at the same time.

In an aspect of the invention, the first means comprises holes formed in the first and second rocker arms at positions at which both holes coincide with each other when both rocker arms engage with the base circles, and a pin operated by the second means so as to be engaged with both the holes, and the second means comprises a hydraulic cylinder, a piston provided in the hydraulic cylinder and engaged with the pin, and control means including a hydraulic circuit for supplying and draining fluid to and from the cylinder at a time when both the holes coincide with each other. cl

DETAILED DESCRIPTION OF THE REFERRED EMBODIMENTS

Figure 1:
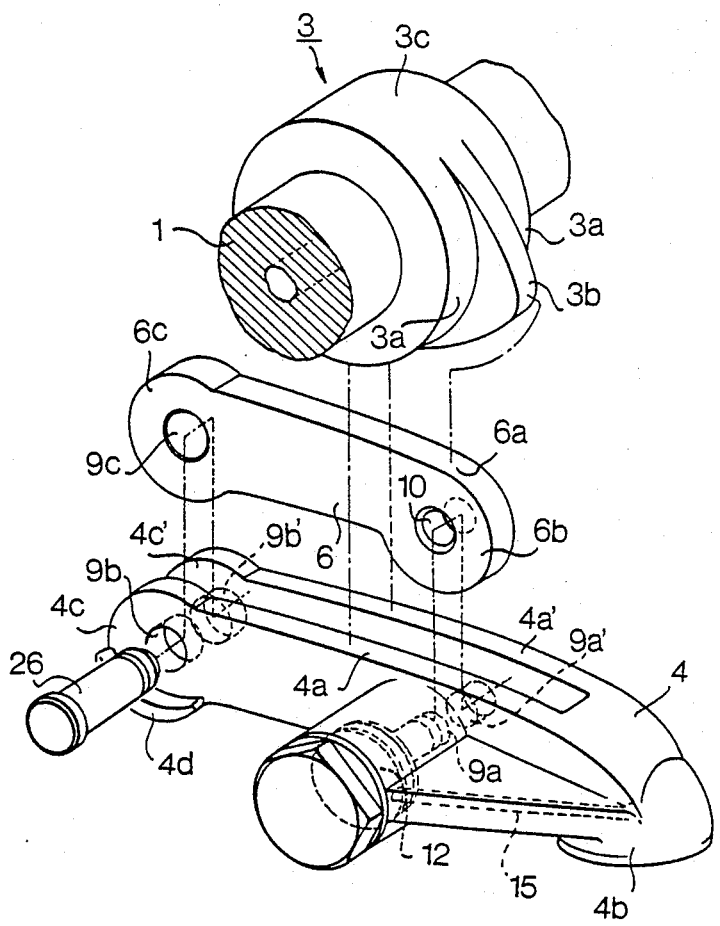
FIG. 1 is an exploded perspective view showing a part of a valve operating system according to the present invention.
Figure 2:
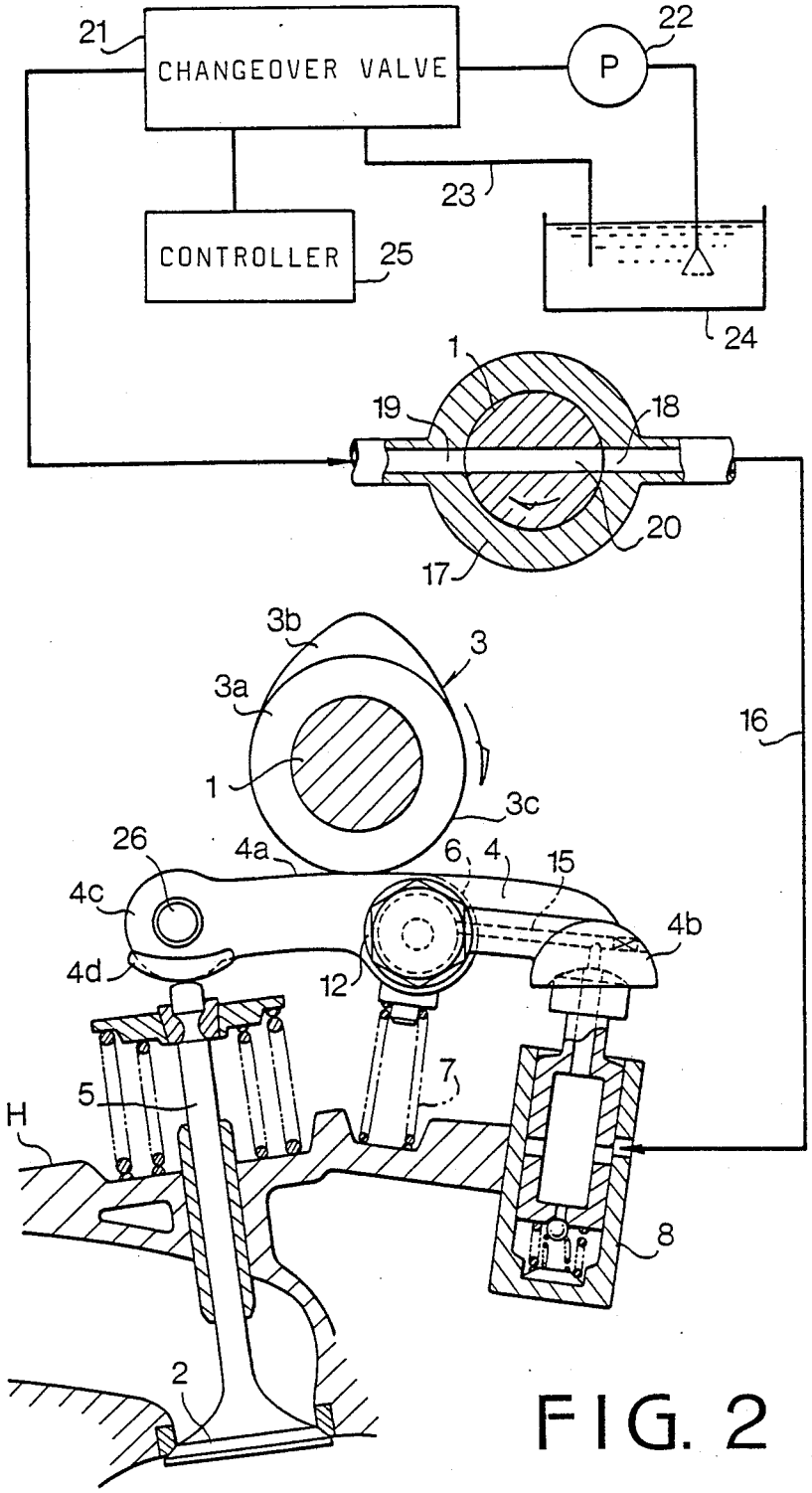
FIG. 2 is a schematic diagram showing the valve operating system.

Referring to FIGS. 1 and 2, a valve mechanism for a valve 2 (for example, an intake valve) according to the present invention comprises a camshaft 1, a cam block 3 formed on the camshaft 1, a first rocker arm 4 having a forked shape, and a second rocker arm 6 to be engaged with the first rocker arm 4.

The cam block 3 comprises a second cam **3*b*, and a pair of first cams 3*a* formed on opposite sides of the cam 3*b*. The cam 3*b* is formed with a lobe providing a predetermined lift for the valve. Each of the first cams 3*a* comprises a cylindrical portion (base circle 3*c*) having a diameter equal to the diameter of a base circle 3*c* of the second cam 3*b***.

The forked first rocker arm 4 comprises an end **4*b* engaged with a hydraulic valve-lash adjuster 8, and a pair of arms 4*a* and 4*a'* corresponding to the first cams 3*a* of the cam block 3. The arms 4*a* and 4*a'* have opposite holes 9*a*, 9*a'* and 9*b*, 9*b'*. The second rocker arm 6 is formed to be disposed between the arms 4*a* and 4*a'* and cooperates with the second cam 3*b*. The second rocker arm 6 has a free end 6*b* having a lateral hole 10 corresponding to holes 9*a*, 9*a'* of arms 4*a*, 4*a'* and an opposite end 6*c* having a lateral hole 9*c* corresponding to holes 9*b*, 9*b'* of arms 4*a*, 4*a'*. The second rocker arm 6 is pivotally mounted on the first rocker arm 4 by a pin 26 securely engaged with holes 9*b*, 9*b'*. The free end 6*b* is held by a spring 7 provided between the underside thereof and a top of a cylinder head H, so that its upper surface 6*a* is pressed against the second cam 3*b***.

The end 4*b* of the first rocker arm 4 is supported by the valve-lash adjuster 8 and a flange 4*d* secured to the end portions, 4*c*′ is engaged with a tip of a stem 5 of the valve 2. Further, the first rocker arm 4 has a lateral hydraulic cylinder 12 integrally formed on an outer side wall of the arm 4*a*.

Figure 5:
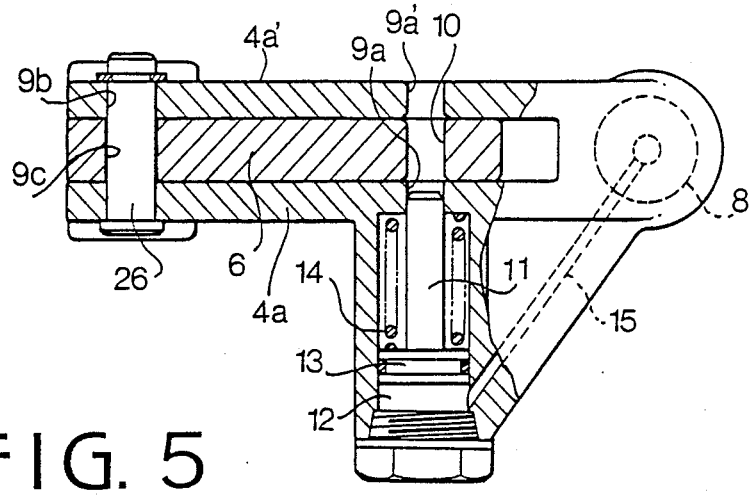
FIG. 5 is a sectional view of rocker arms wherein an engaging pin is in disengaging state.
Figure 6:
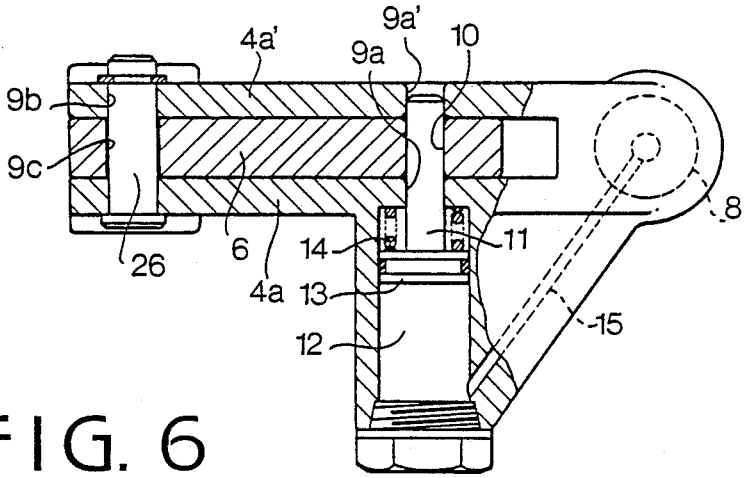
FIG. 6 is a sectional view of rocker arms wherein the pin is in engaging state.

Referring to FIGS. 5 and 6, a lock pin 11 having a piston 13 is provided in the hydraulic cylinder 12. An end of the pin 11 is normally engaged in the hole 9*a* of the arm 4*a*. The piston is urged by a spring 14 to retract the pin 11 from holes 9*a*′ and 10. The mechanism is so arranged that when the base circle 3*c* of the cam 3*b* engages with the upper surface 6*a* of the second rocker arm 6, the hole 10 of second rocker arm 6 is aligned with the holes 9*a*, 9*a*′ of the first rocker arm 4 so that the pin 11 can be projected to engage with holes 10 and 9*a*′ to connect the second rocker arm 6 with the arm 4. For oil supply and drain, the rocker arm 4 has an oil passage 15 connected to the valve-lash adjuster 8.

As shown in FIG. 2, an oil passage 16 for the valve-lash adjuster 8 is connected to a port 18 formed in a bearing 17 for the camshaft 1. The bearing 17 is provided with a port 19 formed opposite to the port 18. The port 19 is communicated with the port 18 through a hole 20 formed in the camshaft 1. The port 19 is selectively connected to a pump 22 and a drain line 23 through a changeover valve 21 which is controlled by a controller 25. Both the pump 22 and drain line 23 are communicated with an oil tank 24.

In the present invention, when the base circle 3*c* of the cam 3*b* engages with the second rocker arm 6, the port 18 is communicated with the port 19 through the hole 20 as shown in FIG. 2.

Figure 3:
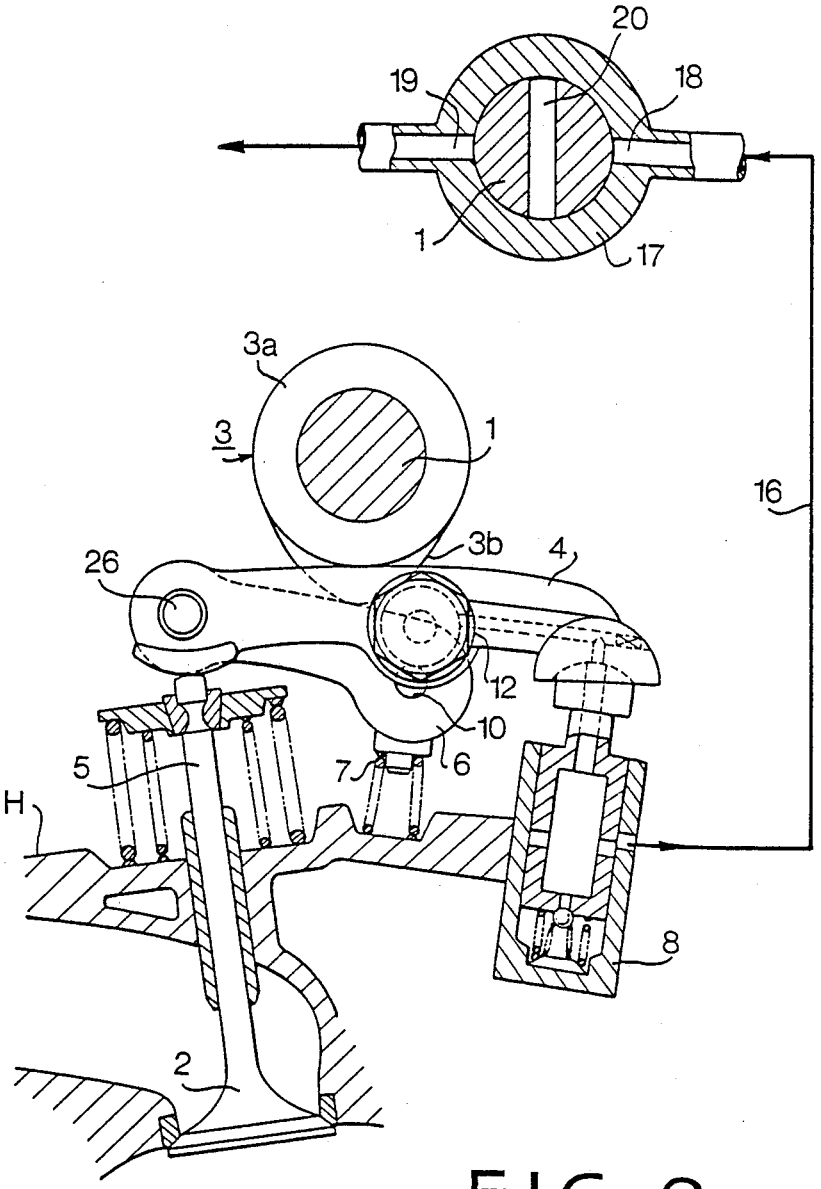
FIG. 3 is a diagram showing an operation state of the valve operating system in which one of the rocker arms is disengaged from the other.

Describing the operation for closing the valve 2 during a low engine speed or a light load of the engine, controller 25 operates to communicate the changeover valve 21 with the drain line 23. When the base circle 3*c* of the cam 3*b* is on the upper surface 6*a* of the second rocker arm 6, the hole 10 of second rocker arm 6 aligns with the holes 9*a*, 9*a*′ of the first rocker arm 4. At this time, the ports 18 and 19 are communicated with each other through the hole 20. Thus, oil in the hydraulic cylinder 12 is drained to the tank 24 through passage 15, adjuster 8 and passages 16 and 23. Accordingly, as shown in FIG. 5, the piston 13 is urged by the spring 14 to retract the pin 11 from the holes 9*a*′ and 10. When the cam lobe of the cam 3*b* engages with the second rocker arm 6, only the arm 6 is rotated in the clockwise direction about the pin 26 against the spring 7 without swinging the rocker arm 4, as shown in FIG. 3. Thus, the valve 2 is not opened.

When the changeover valve 21 is connected to the pump 22 by the controller 25 and the base circles 3*c* of the cams 3*a*, 3*b* engage with the first and second rocker arms 4 and 6, the holes 10, 9*a*, 9*a*′ of the first and second rocker arms 4 and 6 coincide (align) with each other. Thus, the port 19, hole 20 and port 18 are communicated and the oil from the tank 24 is supplied to the cylinder 12 through the passage 16, adjuster 8 and passage 15. The piston 13 is moved by the oil against the spring 14 to push the pin 11 into holes 10 and 9*a*′.

Figure 4:
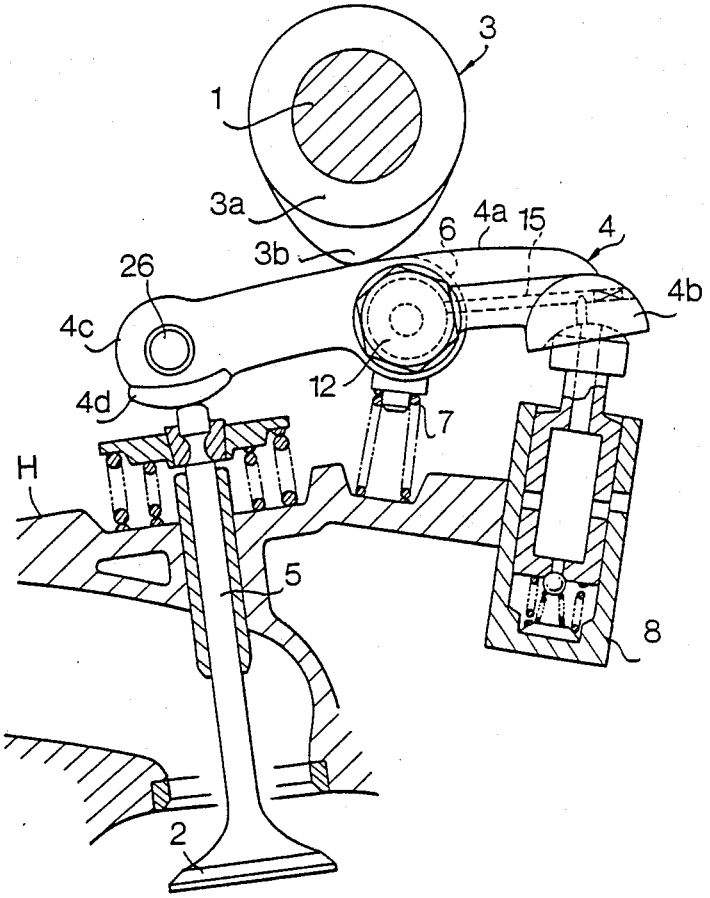
FIG. 4 is a sectional view showing an operation state of a valve mechanism in which two rocker arms are engaged.

As shown in FIG. 4, when the second rocker arm 6 is rocked by the cam lobe of the cam 3*b*, the end portions 4*c* of the first rocker arm 4 are rocked about the top of the adjuster 8 by the arm 6 to push the stem 5 of the valve 2. Thus, the intake valve 2 is opened. Even if the changeover valve 21 is communicated with the drain line 23, unless the base circle 3*c* engages with the second rocker arm 6, the port 19 is not communicated with the port 18, and hence the piston 13 maintains the engagement of the pin 11 with first and second rocker arms 4 and 6.

Referring to FIGS. 7 to 12 showing another embodiment of the present invention, the same parts as the previous embodiment are identified with the same reference numerals as FIGS. 1 to 6.

Figure 7:
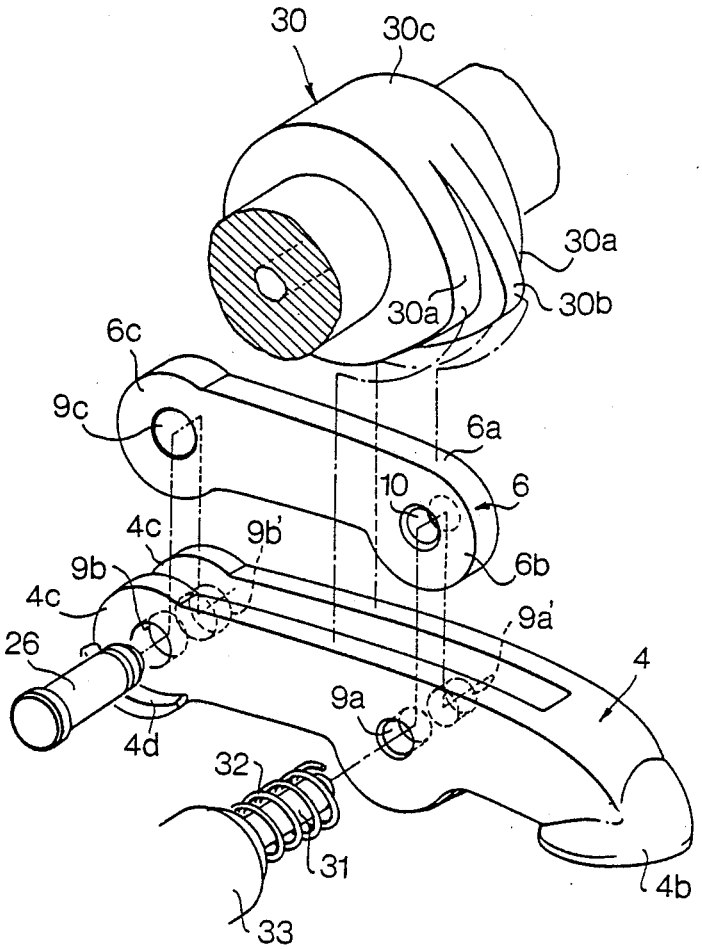
FIG. 7 is an exploded perspective view showing a part of a valve mechanism of another embodiment of the present invention.
Figure 8:
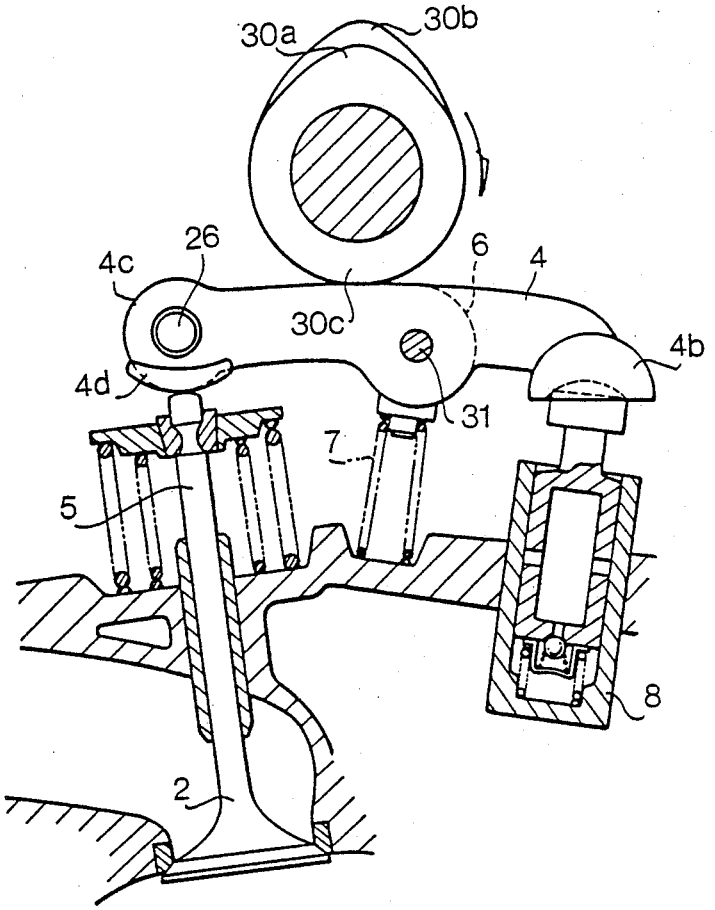
FIG. 8 is a sectional side view of the valve mechanism of FIG. 7.

As shown in FIGS. 7 and 8, a cam block 30 of this embodiment has a pair of first cams 30*a* formed on opposite sides of a second cam 30*b*. The second cam 30*b* is formed to have a high lobe to provide a high valve lift for the valve and, acts on the second rocker arm 6. Each of first cams 30*a* is formed to have a low lobe and acts on the first rocker arm 4. Each cam 30*b* and 30*a* has a common base circle 30*c*.

Figure 9:
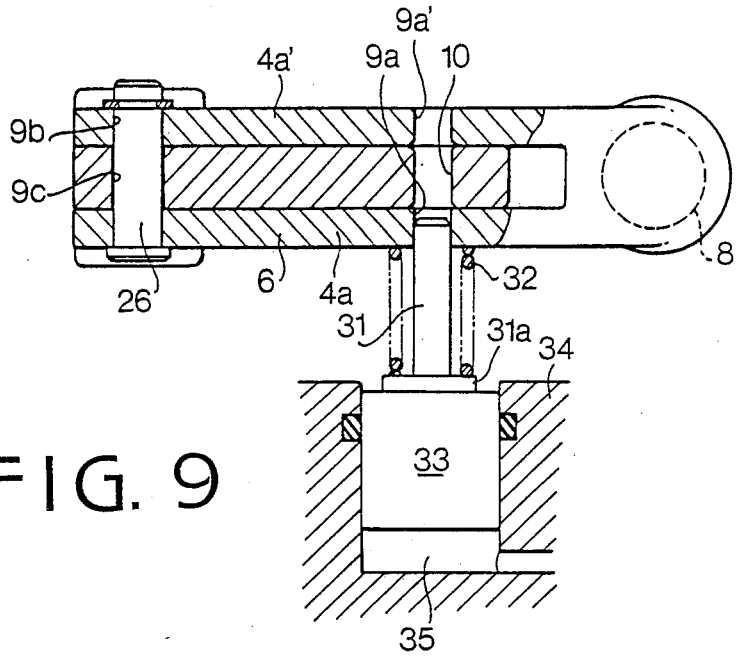
FIG. 9 is a sectional view of rocker arms of the valve mechanism wherein a pin is in disengaging state.
Figure 10:
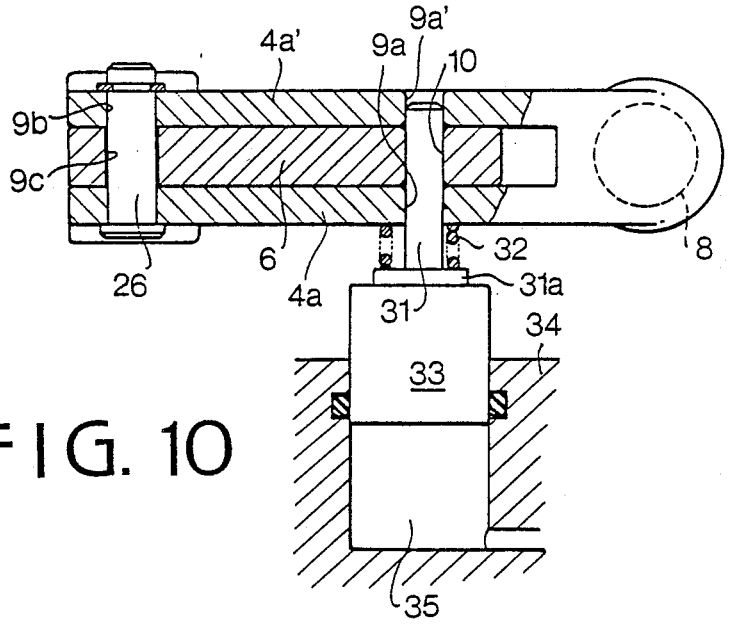
FIG. 10 is a sectional view of rocker arms wherein the pin is in engaging state.

Referring to FIGS. 9 and 10, in place of the pin 11 of the previous embodiment, a pin 31 having a flange 31*a* is slidably engaged with hole 9*a* and selectively engaged with holes 10 and 9*a*′. An oil hydraulic cylinder 35 is formed in a housing 34, in which a piston 33 is slidably engaged. A spring 32 is provided between the outer side wall of the arm 4*a* and flange 31*a*, so that the flange 31*a* is engaged with the outer end surface of the piston 33. Accordingly, when the rocker arms 4 and 6 rock, the flange 31*a* slides on the outer end surface of the piston 33.

Figure 11:
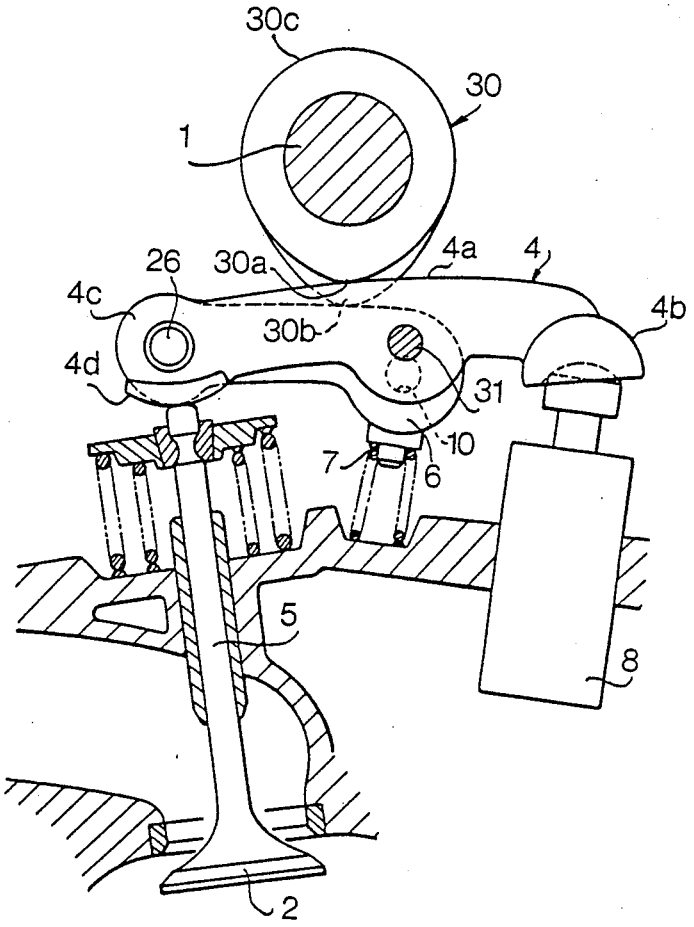
FIG. 11 is a side view showing an operation of the valve mechanism in which a valve is opened at a small lift.
Figure 12:
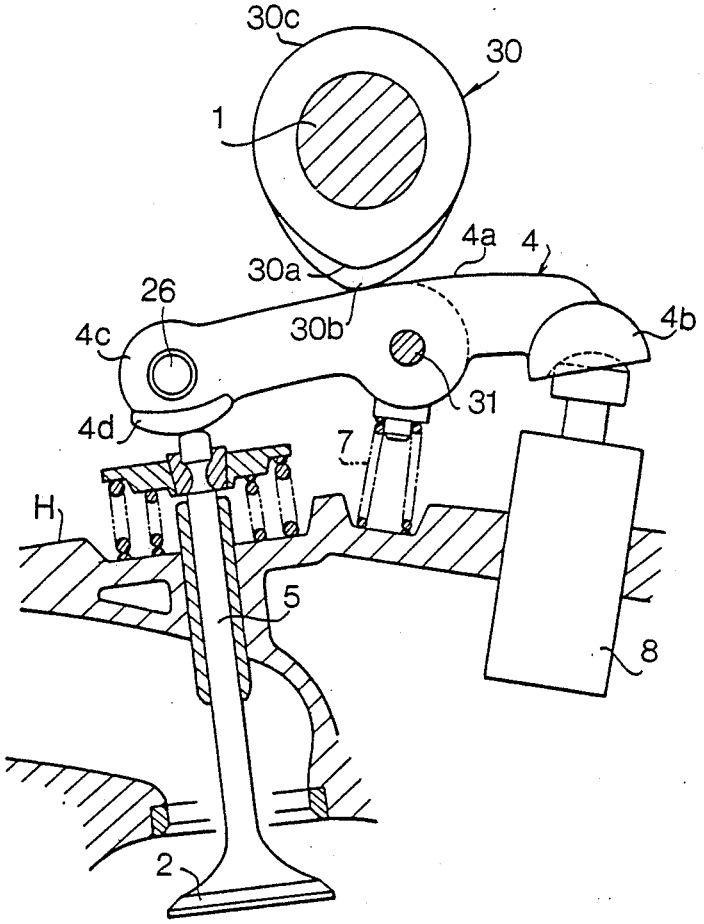
FIG. 12 is a side view showing an operation of the valve mechanism in which the valve is opened at a large lift.

In operation, when the common base circle 30*c* is engaged with the first and second rocker arms 4, 6, the hole 10 of the second rocker arm 6 aligns with the holes 9*a* and 9*a*′ of the first rocker arm 4. Accordingly the pin 31 is engaged with or disengaged from the holes 10 and 9*a*′ by controlling the oil in the cylinder 35 as mentioned in the first embodiment of the invention. Namely, when the oil in the cylinder 35 is drained, the pin 31 is disengaged from the holes 9*a*′ and 10 of rocker arms by the spring 32 as shown in FIG. 9. Accordingly the second rocker arm 6 is independently rocked by the second cam 30*b* and the first rocker arm 4 follows the first cam 30*a* as shown in FIG. 11. Thus valve 2 opens at a small lift.

When the oil is supplied to the cylinder 35, the piston 33 pushes the pin 31 against the spring 32 and the pin 31 is engaged with the holes 10, 9*a*′ as shown in FIG. 10. The second rocker arm 6 follows the second cam 30*b* and the first rocker arm 4 is rocked by the second rocker arm 6. Thus the valve opens at a large lift.

In accordance with the present invention, the hydraulic cylinder operates to move the pin when the base circle of the cam engages with the rocker arms, whereby the pin is aligned with the engaging portions of the rocker arms. Thus, the pin is engaged with or disengaged from the engaging portions of the rocker arms without any difficulties. Therefore, the pin does not strike portions other than the engaging portions, thereby preventing the pin from breaking and making noise. Accordingly, a safe and secure engagement of the rocker arms can be achieved.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A valve operating system for an automotive engine having intake valves and exhaust valves, a cam shaft having cams, and rocker arms rocked by the cams to operate the valves, the system comprising:

at least one of the cams including a first cam and a second cam which are different in shape of contour;

the first cam having a base circle, the diameter of which is equal to that of a base circle of the second cam;

one of the rocker arms including a first rocker arm engaging with the first cam and a second rocker arm engaging with the second cam;

the first and second rocker arms being rotatably engaged with each other so as to be independently rocked by the first and second cams, respectively;

first means on at least one of the first and second rocker arms for selectively engaging the first and second rocker arms with each other, at a position where both the rocker arms engage with the base circles of both the cams, so as to be rocked together by the second cam;

second means including hydraulic means for acting on said first means so that the latter engages and respectively disengages both the first and second rocker arms;

a hydraulic circuit for supplying oil to the second means for operating the second means;

the hydraulic circuit including valve means provided in the cam shaft for supplying the oil to the second means at a time when both the rocker arms engage with the base circles at the same time to engage both rocker arms with each other so as to be rocked together by the second cam.

2. The system according to claim 1 wherein the first cam comprises a pair of cams disposed on both sides of the second cam, and the first rocker arm has a forked shape to form a first branch arm and a second branch arm, the second rocker arm being disposed between the first and second branch arms.

3. The system according to claim 1 wherein the first cam has a contour having the base circle.

4. The system according to claim 1 wherein the first cam has a lobe lower than a lobe of the second cam.

5. The system according to claim 1 wherein the first means comprises holes formed in the first and second rocker arms at positions at which both holes coincide with each other when both rocker arms engage with the base circles, and a pin operated by the second means so as to be engaged with both the holes.

6. The system according to claim 5, wherein the hydraulic means comprises a hydraulic cylinder and a piston provided in the hydraulic cylinder engaging with the pin.

7. The system according to claim 1, wherein said valve means comprises a pair of ports in said hydraulic circuit and a passageway in the cam shaft, the passageway communicatng said ports with each other when both said base circles simultaneously engage said first and second rocker arms.

8. The system according to claim 7, further comprising a bearing, said cam shaft is rotatably disposed in said bearing; and said ports are formed in said bearing of the cam shaft.

9. The system according to claim 1, wherein said hydraulic circuit means includes a pump, a drain and a changeover valve means for selectively communicating said valve means with said pump and said drain, respectively.

10. A valve operating system for an automotive engine having intake valves and exhaust valves, a cam shaft having cams, and rocker arms rocked by the cams to operate the valves, the system comprising:

at least one of the cams including a first cam and a second cam which have are different contours;

the first cam having a base circle, the diameter of which is equal to that of a base circle of the second cam;

one of the rocker arms including a first rocker arm engaging with the first cam and a second rocker arm engaging with the second cam;

the first and second rocker arms being pivotally engaged with each other so as to be independently rocked by the first and second cams, respectively;

locking means for selectively initiating engaging of and completely engaging the first and second rocker arms with each other only at a position where both the rocker arms engage with the base circles of both the cams so that the rocker arms are rockable together by the second cam.

11. The valve operating according to claim 10, wherein said locking means includes a mechanically movable member for the engaging of the first and second rocker arms with each other.

* * * * *